US008720147B2

(12) United States Patent
Roman

(10) Patent No.: US 8,720,147 B2
(45) Date of Patent: May 13, 2014

(54) METHOD AND APPARATUS FOR ATTACHING OBJECTS ON AND ABOVE A CEILING WITH UNATTACHED CEILING PANELS AND CEILING BEAMS

(75) Inventor: Oystein Roman, Sorumsand (NO)

(73) Assignee: Roman Empire AS, Sorumsand (NO)

( * ) Notice: Subject to any disclaimer, the term of this patent is extended or adjusted under 35 U.S.C. 154(b) by 39 days.

(21) Appl. No.: 13/265,341

(22) PCT Filed: Apr. 22, 2010

(86) PCT No.: PCT/NO2010/000146

§ 371 (c)(1),
(2), (4) Date: Oct. 20, 2011

(87) PCT Pub. No.: WO2010/123377

PCT Pub. Date: Oct. 28, 2010

(65) Prior Publication Data

US 2012/0036806 A1 Feb. 16, 2012

(30) Foreign Application Priority Data

Apr. 24, 2009 (NO) ..... 20091641

(51) Int. Cl.
*E04B 9/00* (2006.01)
*E04B 9/18* (2006.01)

(52) U.S. Cl.
CPC ..... *E04B 9/18* (2013.01)
USPC ..... 52/506.07; 52/220.6

(58) Field of Classification Search
USPC ..... 52/506.05, 506.06, 506.07, 506.08, 52/220.1, 220.5, 220.6, 713, 747.1, 745.21
See application file for complete search history.

(56) References Cited

U.S. PATENT DOCUMENTS 806,192 A * 12/1905 Russell ..... 248/59
2,307,653 A * 1/1943 Wright ..... 52/506.06
2,937,589 A * 5/1960 Rachlin ..... 454/297

(Continued)

FOREIGN PATENT DOCUMENTS

DE 2918022 B1 9/1980
EP 0281170 A1 9/1988
EP 0652337 A1 5/1995
GB 802205 10/1958

OTHER PUBLICATIONS

Norwegian Office Action and Search Report; Application No. 20091641; Nov. 5, 2009 (4 p.).

(Continued)

*Primary Examiner* — William Gilbert
*Assistant Examiner* — James Ference
(74) *Attorney, Agent, or Firm* — Conley Rose, P.C.

(57) ABSTRACT

The present invention relates to an apparatus for attaching installations above a ceiling for ceiling panels between substantially inverted T-shaped ceiling beams, the ceiling beams (20) being arranged in a substantially rectangular/square pattern to form T-beam crossings and defining ceiling panel (22) supporting areas. The apparatus includes a fixation base having connection points for the installation with at least three legs (2) extending from the fixation base (1) for connecting the fixation base (1) to the ceiling beams (20) in a beam crossing and for attaching the fixation base (1) at a distance from said beam crossing, as well as an attachment portion (3) for fastening the legs (2) to the beams (20). Also described is a method for attaching installations above a ceiling for ceiling panels (22).

6 Claims, 7 Drawing Sheets

(56) References Cited

U.S. PATENT DOCUMENTS

| | | | | | |
|---|---|---|---|---|---|
| 3,292,332 | A | * | 12/1966 | Jahn | 52/506.07 |
| 3,599,921 | A | * | 8/1971 | Cumber | 248/317 |
| 3,612,461 | A | * | 10/1971 | Brown | 248/317 |
| 3,696,571 | A | * | 10/1972 | Schluter | 52/144 |
| 3,708,941 | A | * | 1/1973 | Cuckson | 52/506.08 |
| 3,835,606 | A | * | 9/1974 | Liberman | 52/220.6 |
| 3,995,823 | A | * | 12/1976 | Hensel | 248/327 |
| 4,160,344 | A | * | 7/1979 | Brugman | 52/39 |
| 4,294,054 | A | * | 10/1981 | Kuhr | 52/506.07 |
| 4,411,116 | A | * | 10/1983 | Maillard et al. | 52/506.06 |
| 4,549,375 | A | * | 10/1985 | Nassof | 52/39 |
| 4,640,077 | A | * | 2/1987 | Hall | 52/665 |
| 4,671,038 | A | * | 6/1987 | Porter | 52/586.1 |
| 4,723,749 | A | * | 2/1988 | Carraro et al. | 248/317 |
| 4,827,687 | A | * | 5/1989 | Frawley | 52/506.06 |
| 5,784,847 | A | * | 7/1998 | Wiklund | 52/506.07 |
| 5,809,730 | A | * | 9/1998 | Renz | 52/506.09 |
| 5,979,134 | A | * | 11/1999 | Neff | 52/506.07 |
| 6,293,056 | B1 | * | 9/2001 | He | 52/39 |
| 6,554,231 | B2 | * | 4/2003 | Choi | 248/65 |
| 7,117,650 | B2 | * | 10/2006 | Dockery | 52/506.07 |
| 7,478,787 | B2 | * | 1/2009 | Bankston et al. | 248/343 |
| 7,614,195 | B2 | * | 11/2009 | Platt et al. | 52/506.06 |
| 2005/0072090 | A1 | * | 4/2005 | Mclaughlin | 52/506.06 |
| 2006/0283132 | A1 | * | 12/2006 | Bankston et al. | 52/698 |
| 2007/0101670 | A1 | * | 5/2007 | Ahren et al. | 52/522 |
| 2008/0060306 | A1 | * | 3/2008 | Platt et al. | 52/506.06 |
| 2008/0155915 | A1 | * | 7/2008 | Howe et al. | 52/220.3 |
| 2008/0302033 | A1 | * | 12/2008 | Insalaco et al. | 52/220.2 |

OTHER PUBLICATIONS

PCT/NO2010/000146 International Search Report, Jul. 6, 2010 (3 p.).

* cited by examiner

METHOD AND APPARATUS FOR ATTACHING OBJECTS ON AND ABOVE A CEILING WITH UNATTACHED CEILING PANELS AND CEILING BEAMS

CROSS-REFERENCE TO RELATED APPLICATIONS

This application is a 35 U.S.C §371 national stage application of PCT/NO2010/000146 filed Apr. 22, 2010, which claims the benefit of Norwegian Application No. 20091641 filed on Apr. 24, 2009, both of which are incorporated herein by reference in their entireties for all purposes.

STATEMENT REGARDING FEDERALLY SPONSORED RESEARCH OR DEVELOPMENT

Not applicable

The present invention relates to an apparatus for attaching objects on and above a paneled ceiling with unattached ceiling panels. Objects to be attached to the fixation base could be, for example, cables, simple pipe and channel mountings, or electronic switching equipment for lighting.

Ceiling beams with unattached ceiling panels are widely used as ceiling in all kinds of buildings. This type of ceiling structures is available from various manufacturers, and varies in shape, size, design, and construction material. Nevertheless, the challenges associated with this kind of ceiling are universal, and the invention may overcome these challenges regardless of manufacturer, shape, size, design, and construction material.

As the distance from a lowered ceiling to the preexisting ceiling may be large, it is often difficult to find attachment points for electronic light switches, cables, simpler pipe and channel mountings, and other lighter equipment for which a fixed installation is (required) presupposed. Craftsmen working with this type of ceiling are highly susceptible to strain injury in that they work with their hands raised above the head often operating heavy tools such as drilling machines, etc. to fasten various equipment. The problems associated with attaching lighter equipment above an unattached paneled ceiling are usually solved in that the equipment is left unattached on the surfaces of the paneled ceiling or in that it is attached to existing structures above and nearby the paneled ceiling. If the equipment is to be attached to an original ceiling or wall above the paneled ceiling, this brings about additional costs in the form of fasteners or cable mountings and also increases the time spent on installation. In addition, the subsequent fastening of such equipment after the paneled ceiling has been installed is very difficult in practice, as there may be a large gap between the paneled ceiling and the original ceiling. When equipment is left unrestrained and unattached above the paneled ceiling, this renders difficult the access from the underside of the paneled ceiling. This causes the installations to move or fall down when ceiling panels are lifted and moved. In turn, this may result in poor electrical connections or in that parts of the installation contact other equipment, potentially causing overheating/ fire hazard or personal injury in that equipment falls down on persons located under the paneled ceiling.

GB 802,205 discloses an assembly for suspending a lattice or cell structure from a ceiling, in particular in connection with lighting. Hence, the assembly is designed for supporting tension between the ceiling and the structure that is to be suspended. However, this solution is not very relevant for an apparatus for attaching objects on and above a paneled ceiling with unattached ceiling panels, thus being adapted for taking up pressure.

According to the book of standards of the Norwegian Electrotechnical Committee (NEK), installations above this kind of ceiling must be securely attached. The apparatus according to the invention may comply with NEK's reference to standards regarding installations within and nearby non-electrical installations in the proximity of electrical installations. Cf. NEK 400:2006, 528.2.3, and 528.2.4. The invention may easily solve this problem by carrying out attachment directly onto the supporting system of the paneled ceiling both in new installations and in existing paneled ceiling constructions for which it is desired to subsequently reattach objects that have been placed directly onto the ceiling panels.

The essential concept of the invention is that the ceiling beams are being used as a foundation and support for products that (require) presuppose a fixed installation. Also, the invention enables the ceiling panels to be lifted up and moved without conflicting with the installation which is performed using the fixation base. The paneled ceiling providers set the limitations on the allowable weight load on their installations. The paneled ceiling providers guarantee that the paneled ceiling installation will be able to support 5 kilograms per $m^2$, in addition to its own weight. The invention is able to support a vertical load of up to 20 kg.

Paneled ceilings comprising ceiling beams of the type in connection with which the present invention is used is found, for example, in U.S. Pat. Nos. 4,723,749, 3,599,921, and EP 0 652 337.

Using the invention, a simple, stable, and safe installation can be ensured that causes the object being attached to be lifted approx. 10 cm from the upper side of the paneled ceiling and anchored to the fixation base. Through the installation of an apparatus according to the invention, it will be possible to lift up and to the side ceiling panels without any conflicts arising between the invention and the ceiling panels. The fastening to the fixation base may be carried out either directly onto the upper side of the fixation base or through the use of pipe mountings or vertical fastening devices. This makes sure the installation remains fixed also during any supplementary work that is carried out above the paneled ceiling. Further, the work associated with the fixation of objects is significantly simplified as it is not necessary to work with the hands raised above the head. There is no need for any tools for attaching the fixation base itself to the supporting beams of the paneled ceiling, as this base is "snapped/clicked/clipped" onto the ceiling beam. The fastening portion for attachment to the ceiling beams is designed to accommodate various beams, and will make sure the fixation base ends up horizontally for object attachment regardless of the beam height. It may also be removed using the same principle and without the use of any tools.

Hence, the present invention relates to an apparatus for attaching installations above a ceiling for ceiling panels between substantially inverted T-shaped ceiling beams, with the ceiling beams being arranged in a substantially rectangular pattern to form T-beam crossings and defining ceiling panel support areas. The apparatus includes a fixation base having connection points for the installations and at least three legs extending from the fixation base for connecting the fixation base to the ceiling beams in a beam crossing; and for attaching the fixation base at a distance from the beam crossing. The apparatus further includes an fastener portion for attaching the legs to the beams.

The fastener portions may comprise supporting members for contacting a lower part of the T-beams.

The fastener portion may have the shape of a U, having two sides and a bottom, of which the two sides have different lengths. The longer side may be constituted by the supporting member, and the supporting member may have an end adapted to abut against the transverse section of the beams in order to make sure the distance between the apparatus and the transverse section will be the same regardless of the beam height. Additionally, the longer side may have an inward step designed for engaging a beam of a particular shape. The shorter side may have two inward steps designed for engaging two different beams. The bottom of the U-shape may be adapted to accommodate the highest beam in connection with which the apparatus is designed for being used. The fastener means may be made of a material that allows the sides to flex slightly outwards to enable the fastener means to snap onto a beam. The legs, fixation base, and fastener means may be cast in one integral piece, or be manufactured as separate parts.

The fastener portion may be tapered and be designed to widen outwards from the beams in order to facilitate the insertion and removal of ceiling panels.

The length of the legs may be adapted so that a ceiling panel may be inserted and/or be removed without conflicting with the fixation base.

The fixation base may include a series of openings in a pattern adapted to standard configurations for electrical components and other installation parts.

The apparatus may be designed for enabling several apparatuses to be stacked on top of each other.

Typically, the apparatus may comprise three or four legs.

The invention also relates to a method for attaching installations above a ceiling for ceiling panels extending between substantially inverted T-shaped ceiling beams, the ceiling beams being arranged in a substantially rectangular pattern to form T-beam crossings and defining ceiling panel support areas, using an apparatus as described above. The method includes attaching a first one of the legs to a first ceiling beam, nearby a location at which a second ceiling beam crosses the first ceiling beam, attaching two other of the legs to the second crossing ceiling beam, attaching the last leg to the first ceiling beam at the opposite side of the second crossing beam. Finally, the installation may be attached to the fixation base. Of course, the installation may also be attached to the apparatus before the apparatus is fixed to the ceiling beams.

The apparatus may be fastened to the supporting beams of the ceiling at the cross bars without the use of any tools.

The upper side of the fixation base may be prepared to allow for the direct fastening of objects.

The fixation base may be provided with a series of holes for attaching supplementary fasteners. This may include holes for existing pipe mountings as well as vertical attachment means.

The attachment to the supporting beams of the paneled ceiling may be shaped so as to fit any of the most commonly used beam heights available on the market. The attachment mechanism may allow for different fastening to beams of differing heights in order to be able to elevate the fixation base horizontally on all structures.

The attachment may be constructed for ease of attachment and removal having explanatory numbered instructions for no-tool method of attachment. The construction and design allows for easy access to the handling of ceiling panels when access above the paneled ceiling is needed.

The attachment apparatus is designed in such a manner that it will not cause any damage to ceiling panels adjacent to the crossing at which the apparatus is installed.

The apparatus may strengthen the ceiling structure itself in that it adds rigidity to the beams of the installation.

DETAILED DESCRIPTION OF AN EMBODIMENT OF THE INVENTION WITH REFERENCE TO THE ACCOMPANYING DRAWINGS

Figure 1:
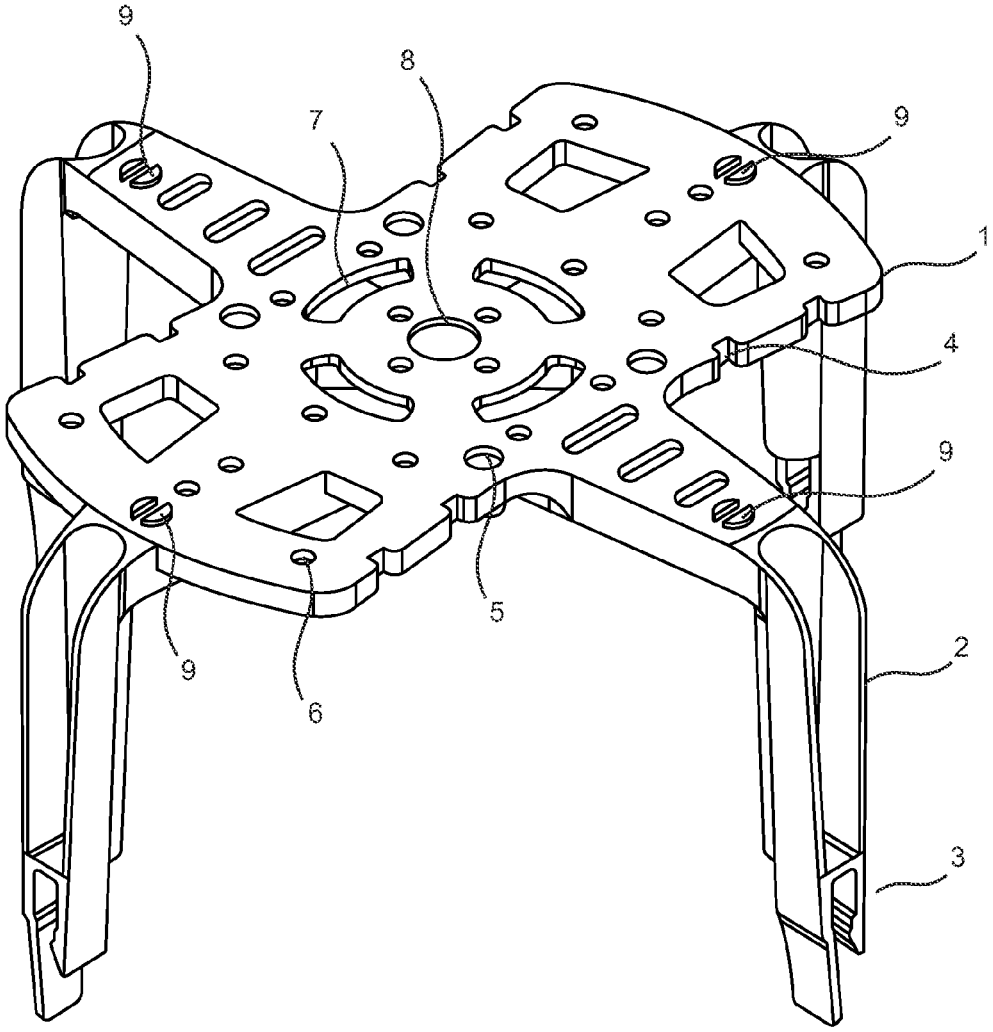
FIG. 1 is a top perspective view showing an apparatus according to the invention.

In FIG. 1, an apparatus according to the invention can be seen. Typically, the apparatus may be divided into three main components, constituted by the fixation plate 1, four attachment legs 2, and fastening portion 3 for attachment to a ceiling beam. The fixation base 1 includes attachment grooves 4 for seizing equipment, typically fastening by way of strips. Typically, the attachment grooves 4 will make sure the strips used for the fastening will not slide off of the fixation base, but be held in place. The outwardly widening shape of the attachment plate also helps preventing strips tightened around the plate from sliding off. Additionally, the fixation base includes attachments for a pipe mounting 5 and other additional elements. The holes or mountings 5 may be specially adapted for a pipe attachment clip. This clip may be used for fastening of both electrical pipes as well as water or gas pipes, for example. The holes 6 may be pre-cast holes for screws and other additional elements. The openings or holes 7 may be adapted for the fastening of larger additional elements. Typically, hole 8 may be adapted for the feed-through of cables, and a cable may be pulled through the holes. Installation instructions 9 having order of attachment numbering, for example, may be cast into the apparatus.

Typically, the apparatus may have standard dimensions and have a height of about 11.5 cm, a width of about 9 cm, and a length of about 19 cm. Products may have other dimensions as well, but these dimensions cover many of the areas of use and the elements that normally have to be attached above a paneled ceiling. Legs 2 and fastening portion 3 at the end of legs 2, as well as the other dimensions of the apparatus, are constructed in such a manner that the ceiling panels resting on the beams may be easily handled and lifted off or put in place with no interference from the apparatus. This is ensured by the spacing between the fixation base 1 and the beams. Hence, the spacing is important in order for the ceiling panels to be able to be handled and lifted up or be removed. The design is carried out so as to not cause any damage to the ceiling panels located adjacent to the crossing at which the apparatus is installed.

The fixation base 1 may be substantially plane and may be used for the direct installation or for fastening of the additional elements as mentioned above for pipe mountings, vertical mounting plates or other elements. The legs 2 of the apparatus may be fastened to the supporting cross beams of the ceiling structure (see FIG. 4). Thus, the ceiling beams will support the apparatus. The mounting part or fastening portion 3 at the end of legs 2 connected to the fixation base 1 is shown implemented as a snapping/clicking system for attachment to the ceiling beams. The configuration shown is adapted to fit all presently commercially available beams, despite their differing heights and shapes. The fastening portion 3 of the apparatus is adapted to accommodate beams of various dimensions. In case of height differences between the profiles of the cross bars of the supporting beams (where the supporting beams meet each other in a crossing), the fastening portion 3 of the apparatus will be adapted to be able to ensure a horizontal attachment of the fixation base.

The fastening portion 3 may also configured in other ways including other fasteners such as screws and the like or may include u-shaped bodies with no clip fasteners, and the apparatus may then be held in place by gravity. This solution, however, is considered less advantageous.

Figure 2:
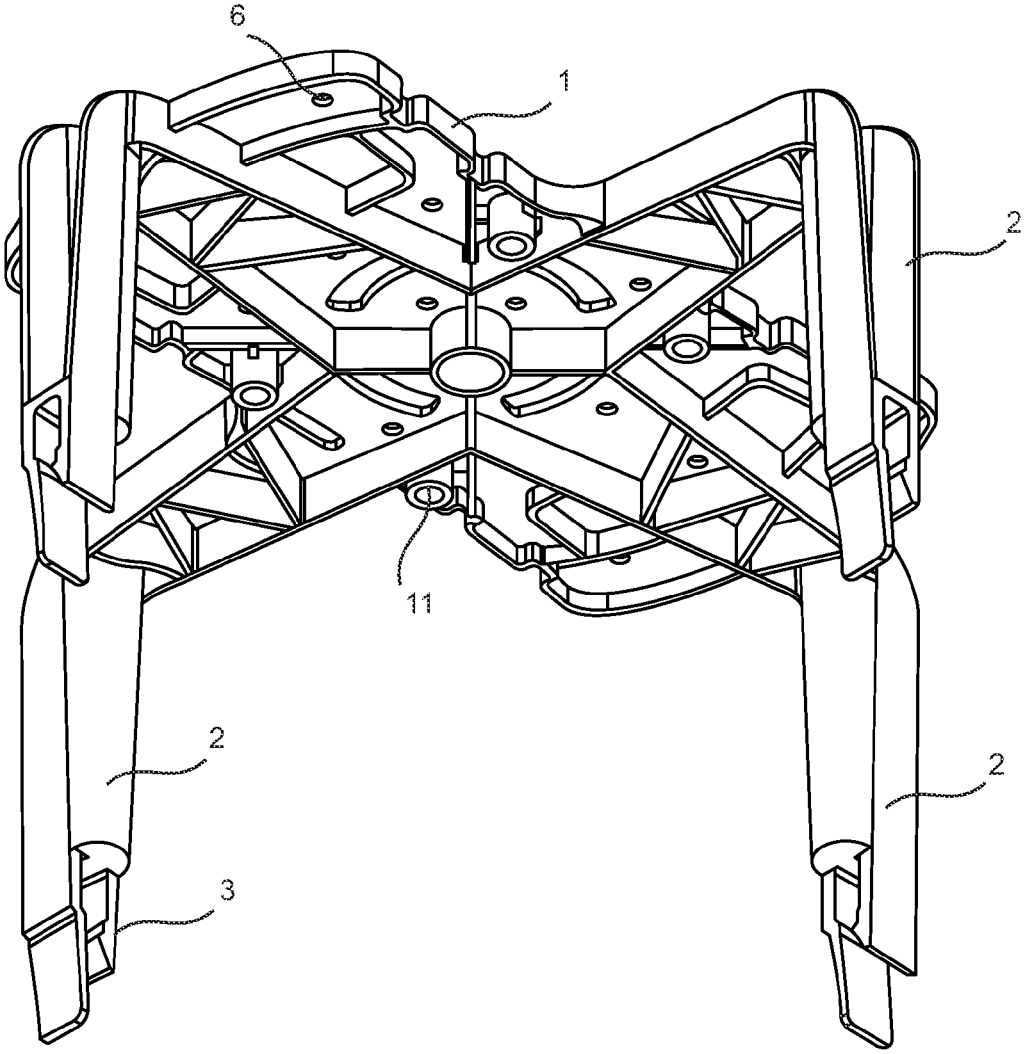
FIG. 2 is a bottom perspective view showing the apparatus of FIG. 1.

In FIG. 2, the apparatus according to the invention is shown in a bottom perspective view, in which the fixation base 1 is shown with reinforcement ribs for increasing the stiffness of the fixation base. Also shown are four legs 2 with a fastening portion 3 for attachment to a supporting beam. Preexisting punched or cast holes 6 for screws and other additional fasteners can also be clearly seen. As shown, pre-machined thread areas 11 may also be provided, if desired.

Figure 3:
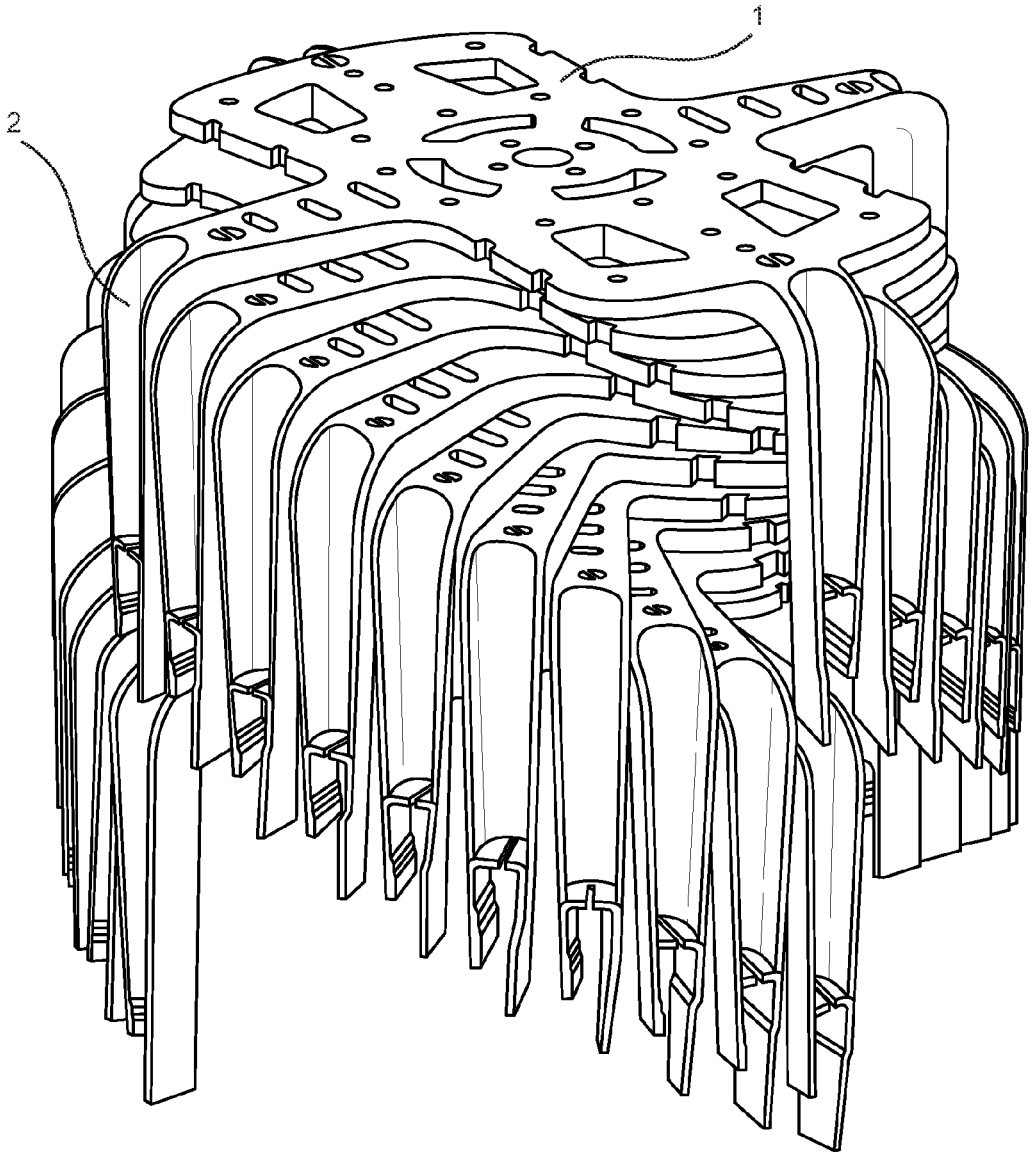
FIG. 3 shows ten assemblies as shown in FIGS. 1 and 2, stacked on top of each other.

From FIG. 3, it appears that the apparatus design as shown in FIGS. 1 and 2 allows the assemblies to be stacked on top of each other in a favorable space-saving configuration, as readily apparent from FIG. 3 showing ten assemblies having the fixation base 1 and legs 2 stacked onto each other. In the case of stacking, the individual assemblies are turned so that the legs form an upward stairway.

Figure 4:
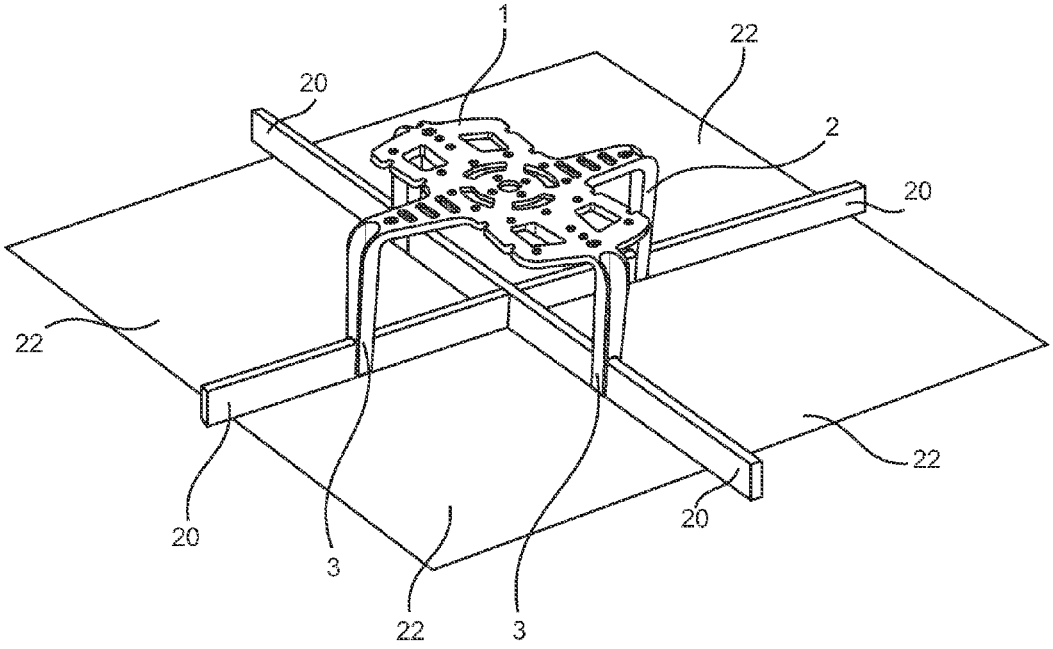
FIG. 4 shows an apparatus according to the invention attached to particular ceiling beams.

In FIG. 4, an apparatus is shown having a fixation base 1 and legs 2 including a fastening portion 3 for a ceiling beam. The apparatus is shown installed in crossing ceiling beams 20, with ceiling panels 22 having been inserted into the beams. FIG. 4 shows how the apparatus will be positioned above a paneled ceiling as well as how the apparatus will be attached to ceiling beams 20 through the fastening portion 3.

Figure 5:
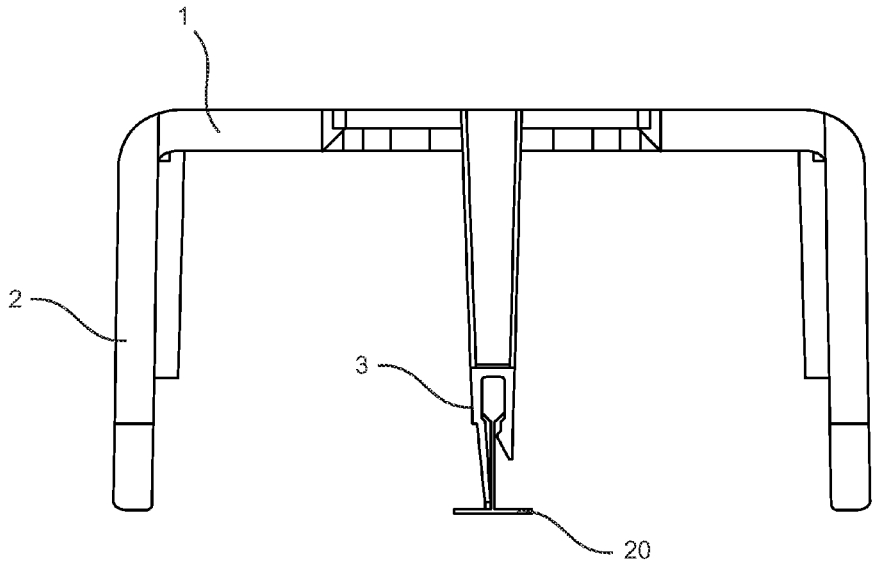
FIG. 5 is a side view showing an apparatus according to the invention.
Figures 5A, 5B, 5C:
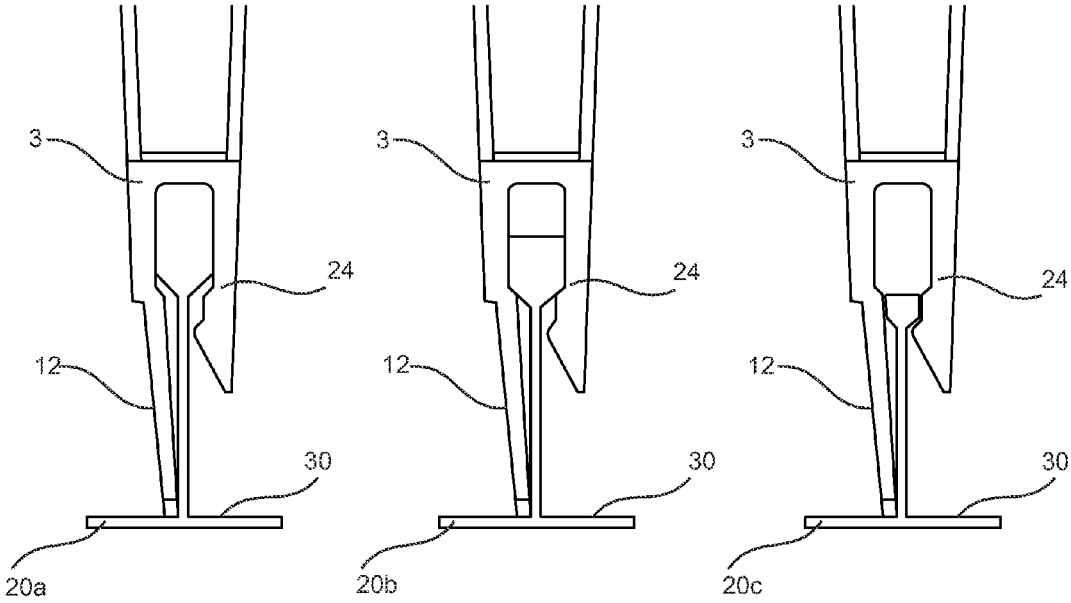
FIGS. 5*a*-5*c* show details of the apparatus according to the invention, as attached to various ceiling beams.

In FIG. 5, the apparatus appears in greater detail in a side view, from which it can also be seen how the apparatus is clipped onto a beam 20. FIGS. 5*a*, 5*b*, and 5*c* are a detailed sectional view showing the manner in which the fastening portion 3 is attached to various ceiling beams 20*a*, 20*b*, and 20*c*. The fastening portion 3 is shown provided with a supporting element 12 adapted to rest against transverse sections 30 of beams 20.

In a global perspective, three standardized supporting beams exist for the paneled ceiling system for which the apparatus according to the invention has been developed. The beams have the same physical dimensions regardless of manufacturer. From FIGS. 5*a*, 5*b*, and 5*c*, it can be seen how the apparatus according to the invention is adapted to be usable with all the three standardized supporting beams currently available. All these three standards may be used in the installation of the one and same ceiling. These assemblies are used provided that the paneled ceiling can be installed with a grid of support beams. It can be seen how the fastening portion 3 may be attached to ceiling beams 20 of three different shapes and dimensions. As indicated in FIGS. 5*a*, 5*b*, and 5*c*, the apparatus will rest, via supporting element 12, against the upper left side of the transverse sections 30 or the horizontal edge of each of the beams of a cross bar. A detent lock 24 is part of the fastening portion 3 on legs 2 of the apparatus, and securely fixes the apparatus to the ceiling beams.

Figure 5D:
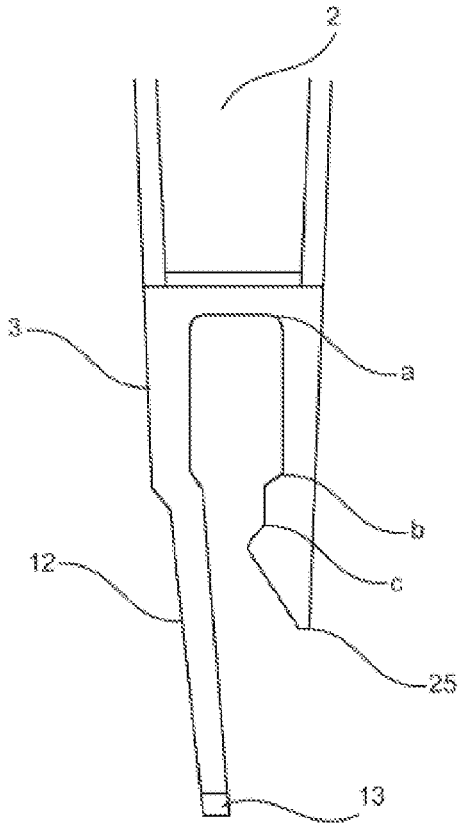
FIG. 5*d* shows a lower part of the legs in more detail.

FIG. 5*d* shows the fastening portion 3 in more detail. The fastening portion 3 has the shape of a U, with two sides and a bottom, but of which the two sides have unequal lengths. The longer side 12 has an end 13 adapted to abut against the transverse section of the beams to make sure the distance between the apparatus and transverse section will be the same regardless of the beam heights. The longer side 12 also has an inward step adapted for engaging a beam of a particular shape. The shorter side 25 has two inward steps b, c for engaging two different beams. The bottom of the U-shape, a, is adapted to accommodate the highest beam with which the apparatus is intended to be used. The fastening portion is made of a material allowing the sides to flex slightly outwards to enable the fastening portion 3 to snap onto a beam.

The inward steps shown as b and c are adapted to the various beams 20*a*, 20*b*, and 20*c* shown in FIGS. 5*a*, 5*b*, 5*c*, 5*e*, 5*f*, and 5*g*, and provides for fastening to the individual beams.

Figure 5E:
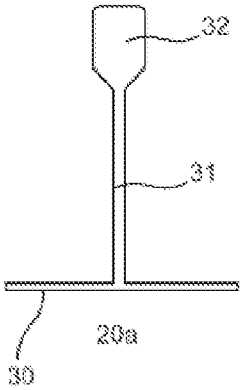
FIGS. 5*e*-5*g* show cross-sections of typical ceiling beams to which the apparatus according to the invention typically will be attached.
Figure 5F:
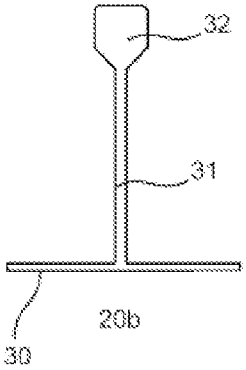
Figure 5G:
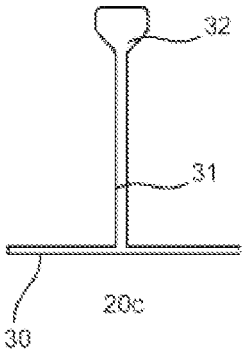

FIGS. 5*e*, 5*f*, and 5*g* show the three beams 20*a*, 20*b*, and 20*c*. Beam 20*a* in FIG. 5*e* shows that the beam 20*a* has an enlarged flange section 32 and a tapered section 31 connected to the transverse section 30. From FIGS. 5*e*, 5*f*, and 5*g*, it can be seen that the beam of FIG. 5*e* is higher than beam 20*b* of FIG. 5*f*, which, in turn, is higher than beam 20*c* of FIG. 5*g*. As can be seen, the fastening portion 3 of the apparatus is adapted for the fastening of any of these beams, even though the distances between the enlarged section 32 and the transverse section 30 are not equal for the different beams 20*a*, 20*b*, and 20*c*. FIG. 5*e* shows a beam 20*a* having a 24 mm wide transverse section. The distance between the transverse section 30 and the enlarged section 32 is the length of the tapered section 31, which in this case is 25 mm. The tapered section 31 extends into the enlarged section 32, which has a height of 13 mm and a width of 6.8 mm.

In FIG. 5*f*, beam 20*b*, which also has a transverse section 30 having a width of 24 mm, is shown. The narrow section 31 extending between the enlarged section 32 and the transverse section 30 has a length of 24 mm. The enlarged section 32 has a length of 8 mm and a width of 6.8 mm.

In FIG. 5*g*, beam 20*c*, of which the narrow section 31 between the transverse section 30 and enlarged section 32 has a length of 21 mm, is shown. On the beam shown as 20*c*, the enlarged section 32 is curved having a diameter of approximately 5 mm. For this beam, the distance between the transverse section 30 and the top of the enlarged section 32 is 25 mm.

These beams have been described in detail in order to show typical beams that the present invention aims to accommodate, and these beams also dictate the internal shape of the fastening portion.

Referring back to FIG. 5*d*, inward steps 25 fitting into the various beams 20*a*, 20*b*, and 20*c* are shown. FIG. 5*d* also shows the fastening portion, and it is necessary that the fastening portion 3 comprises a material having a certain flexibility so that the fastening portion 3 can be pressed onto a beam and attach thereto in that the fastening portion 3 grips around the beam, and so that one of the steps 25 abuts against the lower part of the enlarged section 32 shown in FIGS. 20*a*, 20*b*, and 20*c*. FIGS. 5*a*, 5*b*, and 5*c* shows the manner in which the respective beams 20*a*, 20*b*, and 20*c* abut against the respective steps 25 shown in FIG. 5*d* in order to retain the apparatus according to the invention in beams 20*a*, 20*b*, and 20*c*.

Figure 6:
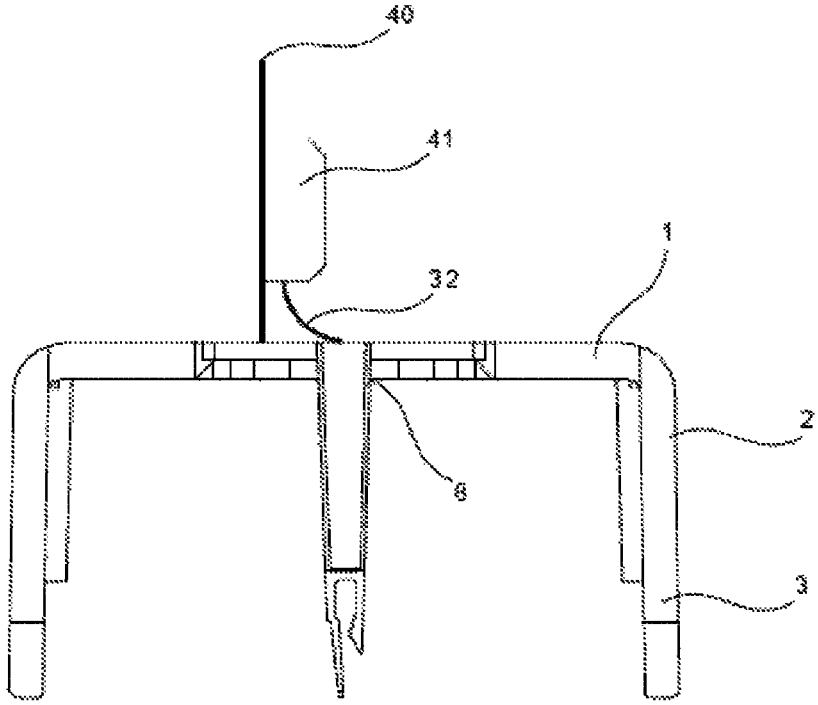
FIG. 6 is a side view showing an apparatus according to the invention, in which an additional vertical attachment plate has been attached.
Figure 6A:
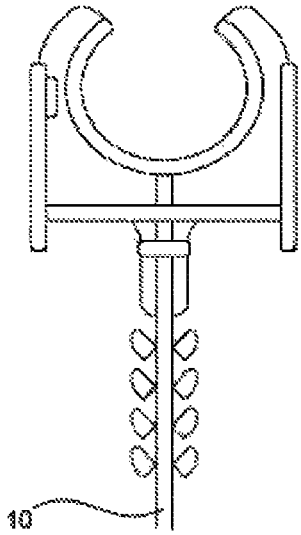
FIG. 6*a* shows an exemplary pipe mounting that may be attached to the apparatus according to the invention.

In FIG. 6, an apparatus according to the invention is seen in a side view, having a fixation base 1, legs 2, and a ceiling beam fastening portion 3. In addition, a vertical mounting plate 40 has been installed, which may be fastened, for example, in attachments 5, 6, or 7 as shown in FIG. 1. For example, the vertical mounting plate 40 may provide a foundation for an electric socket 41. A cable 32 is shown thread up through the hole 8. Hole 8 appears more clearly in FIG. 1. FIG. 6*a* shows a 6 mm pipe mounting 10 which may typically be fastened in the attachments 5 as shown in FIG. 1.

During installation, installation instructions 9 (shown in FIG. 1) with order of attachment numbering may appear. Symbol 1 may indicate that this leg must be pressed down and attached to the ceiling beams first. Then, according to instructions, the apparatus is pushed away and thereafter attached at symbol 2, which is indicated with arrows at two of the legs. At this point, when the legs meet the transverse beams, the apparatus is pressed down, while at the same time the last connection point is clicked in place, as shown with symbol 3.

The structure is typically designed so as to be able to resist loads of 20 kg, for example. The product will typically be cast in plastic, but could also possibly be designed so as to allow its construction from other materials such as aluminum, for example. The structure is designed in such a manner that it may easily be handled using one hand during installation. The apparatus may be attached to the beams without the use of any tools. The apparatus may also be de-installed or removed from the beams without the use of any tools. Additionally, the apparatus will strengthen the ceiling construction itself in that it adds rigidity to the beams of the installation.

The invention claimed is:

1. An apparatus for attaching installations above a ceiling for ceiling panels between substantially inverted T-shaped ceiling beams with a beam height, the bottom of the inverted T-shape forming a transverse section, and wherein the ceiling beams are arranged in a substantially rectangular pattern to form beam crossings and defining ceiling panel supporting areas, the apparatus comprising:

a fixation base including connection points for installations;

at least three legs extending from the fixation base, wherein the legs are configured to connect the fixation base to the ceiling beams in a beam crossing and the fasten the fixation base at a distance from the beam crossing; and a fastening portion configured to attach the legs to the beams above the ceiling so that the apparatus is supported by the beams;

wherein the fastening portion includes a supporting member for contacting a lower part of the T-shaped ceiling beams;

wherein the fastening portion includes a U-shaped cross-section, including two sides and a bottom, with the two sides being different lengths, a longer side and a shorter side, and the longer side being constituted by the supporting member;

wherein the supporting member includes an end configured to abut against the transverse section of the beams to ensure a distance measured between the fixation base and the transverse section will be the same regardless of the beam height;

wherein the fastening portion longer side includes an inward step configured to engage a first of the beams having a first geometry;

wherein the fastening portion shorter side includes two inward steps configured to engage a second of the beams having a second geometry or a third of the beams having a third geometry;

wherein the bottom of the U-shaped cross-section is configured for a higher beam of said beams with which the apparatus is intended to be used; and wherein the fastening portion comprises a material allowing the sides to flex slightly outwards for the fastening portion to be able to be snapped onto a beam.

2. The apparatus for attaching installations according to claim 1 wherein the fastening portion is tapered and configured for widening outwards from the beams to facilitate the insertion and removal of said ceiling panels.

3. The apparatus for attaching installations according to claim 1 wherein each of said legs has a length configured to allow insertion and removal of a ceiling panel without conflicting with the fixation base.

4. The apparatus for attaching installations according to claim 1 wherein the fixation base includes a series of openings configured to receive installation components in a predetermined arrangement.

5. The apparatus for attaching installations according to claim 1, configured to support a plurality of said apparatuses stacked on top of each other.

6. The apparatus for attaching installations according to claim 1, wherein the at least three legs comprises four legs.

* * * * *